US008794472B2

(12) United States Patent
Hughes

(10) Patent No.: US 8,794,472 B2
(45) Date of Patent: Aug. 5, 2014

(54) COVERS FOR WINEGLASSES OR LIKE CONTAINERS

(76) Inventor: John Hughes, London (GB)

( * ) Notice: Subject to any disclaimer, the term of this patent is extended or adjusted under 35 U.S.C. 154(b) by 365 days.

(21) Appl. No.: 12/310,587

(22) PCT Filed: Aug. 7, 2007

(86) PCT No.: PCT/GB2007/003143

§ 371 (c)(1),
(2), (4) Date: Mar. 27, 2009

(87) PCT Pub. No.: WO2008/025948

PCT Pub. Date: Mar. 6, 2008

(65) Prior Publication Data

US 2010/0237077 A1 Sep. 23, 2010

(30) Foreign Application Priority Data

Aug. 31, 2006 (GB) ..... 0617072.4

(51) Int. Cl.
*B65D 51/00* (2006.01)
*A47G 19/22* (2006.01)

(52) U.S. Cl.
CPC ..... *A47G 19/2211* (2013.01); *A47G 19/2222* (2013.01)
USPC ..... 220/287; 220/323; 220/787; 220/709; 215/294

(58) Field of Classification Search
CPC ..... B65D 51/08; B65D 2517/0098; A47G 19/2211; A47G 19/2222
USPC ..... 220/323, 712, 315, 810, 23.86, 779, 220/800, 716, 718, 719, 709, 707, 801, 787, 220/287; 215/299, 293–294; 229/404, 4.5, 229/5.5, 400; 239/16, 30; 248/312, 79, 248/312.1
See application file for complete search history.

(56) References Cited

U.S. PATENT DOCUMENTS 871,271 A * 11/1907 Hall ..... 215/235
1,667,770 A * 5/1928 Carpmael ..... 215/294

(Continued)

FOREIGN PATENT DOCUMENTS

DE 26 21 121 A1 11/1977
DE 29 25 660 1/1981

(Continued)

OTHER PUBLICATIONS

International Search Report.

(Continued)

*Primary Examiner* — Mickey Yu
*Assistant Examiner* — Chun Cheung
(74) *Attorney, Agent, or Firm* — Collard & Roe, P.C.

(57) ABSTRACT

Cover means (10) for a wineglass or like container (24) are made from a flat sheet (10), and comprise means (20, 521) adapted to be bent from the sheet (10) and used to inhibit the cover means (10) from slipping off the container, which inhibiting means (20) comprise an inhibiting element (20), e.g. a tab (20), adapted to be bent from the sheet at one or more bends (22, 50, 54) inwards of the periphery (18) of the cover means (10), whereby the whole of said element (22) is located inwards of and spaced from the periphery (18) or at least one said bend (22) extends inwards from said periphery (18). Two, three or more of said elements (20) may be adapted to be inside and/or outside the rim (26) of the container (24). Such an element (20) may point radially or circumferentially, and may be cut from the sheet (10) (or have a line 12 of weakening for ready separation from the sheet 10) apart from at said bend (22). Said elements (20) may be spaced apart around the cover means (10) and/or at different distances from a center to suit the diameters of respective said containers (24). A non-tab form said element (521) may have a cross-section of V-shape in a circumferential direction. The cover means (10) may be formed into a conical shape, e.g. by interlocking means (322, 342), e.g. comprising hook means (322, 342), or be held in conical shape by bending alone; and/or may be adapted to be such that the action of using a finger to apply pressure downwards at one portion of the outer edge of the cover (10) will lever the cover (10) up at the opposite side of the container (24).

14 Claims, 6 Drawing Sheets

(56) References Cited

U.S. PATENT DOCUMENTS

| | | | | | |
|---|---|---|---|---|---|
| 1,890,460 | A | | 12/1932 | Gebhard | |
| 2,637,462 | A | * | 5/1953 | Becker | 220/800 |
| 2,878,931 | A | * | 3/1959 | Stroheim | 206/320 |
| 3,141,567 | A | * | 7/1964 | Schearer | 220/287 |
| 3,212,416 | A | * | 10/1965 | Boersma | 210/164 |
| 5,114,036 | A | * | 5/1992 | Liu | 220/787 |
| 5,265,752 | A | * | 11/1993 | Olson | 220/380 |
| 5,588,552 | A | | 12/1996 | Johnson | |
| 2007/0158356 | A1 | * | 7/2007 | Cunningham | 220/801 |

FOREIGN PATENT DOCUMENTS

| | | | |
|---|---|---|---|
| FR | 2 184 465 | A | 12/1973 |
| GB | 2 409 964 | A | 7/2005 |

OTHER PUBLICATIONS

European Office Action for John Hughes dated May 13, 2013 5 pages.
English Translation of DE 29 25 660 via Machine Translation.

* cited by examiner

FIG. 8
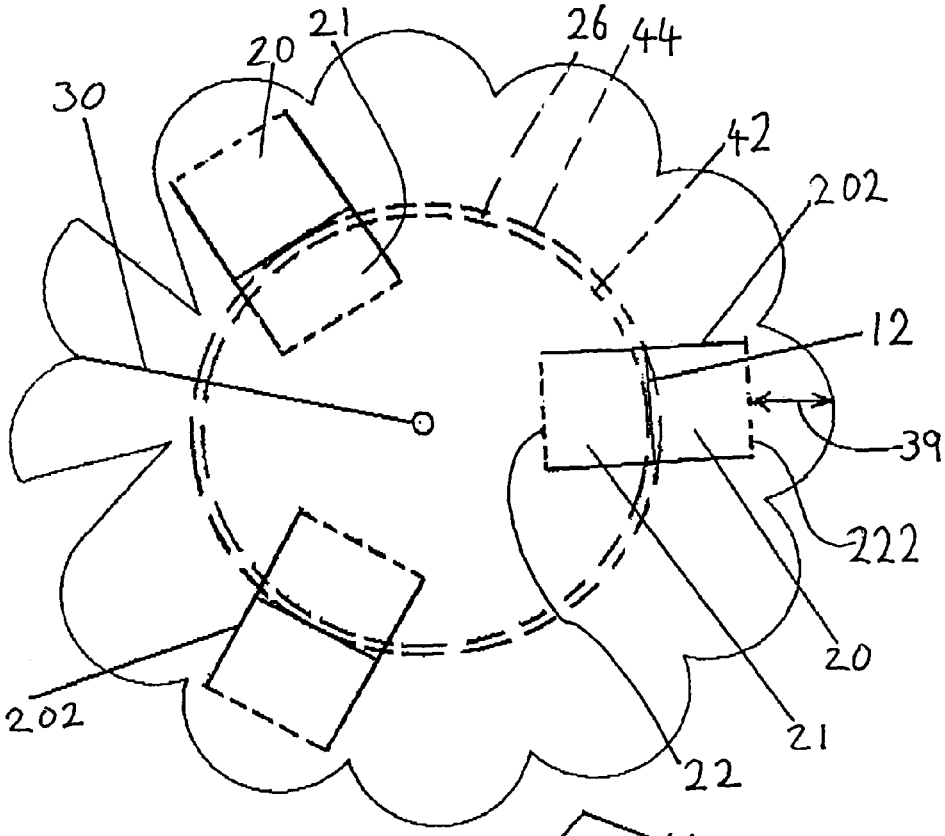
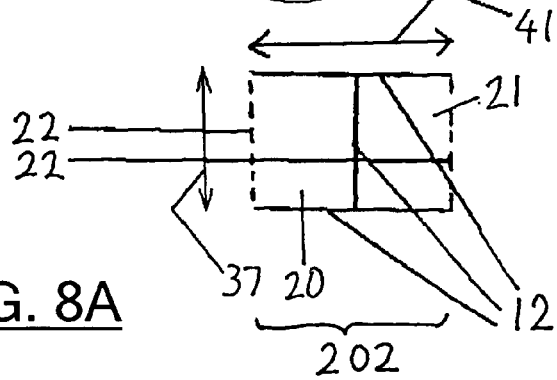
FIG. 8A

COVERS FOR WINEGLASSES OR LIKE CONTAINERS

CROSS REFERENCE TO RELATED APPLICATIONS

This application is the National Stage of PCT/GB2007/003143 filed on Aug. 7, 2007, which claims priority under 35 U.S.C. §119 of Great Britain Application No. 0617072.4 filed on Aug. 31, 2006. The international application under PCT article 21(2) was published in English.

FIELD OF THE INVENTION

This invention relates to covers for wineglasses or like containers, which term used herein includes, for example, tumblers, cups, medicine glasses or other drinking containers or other containers that normally have an open top (i.e. a mouth with a top rim) through which undesirable foreign matter may enter and contaminate the contents, e.g. dust, dirt or insects falling or flying in, or setting.

BACKGROUND

A cover for a wineglass or like container may be a simple circular sheet with a hole in the middle for a drinking straw, but this slips off the glass easily. To stop it from sliding off the glass, some shapes have been proposed but these are either complicated or ineffective.

THE INVENTION

According to one aspect of the invention, there are provided cover means for a wineglass or like container that are made from a flat sheet and are adapted to lie across the mouth and top rim of the container, and comprise means adapted to be bent from the sheet and used to inhibit the cover means from slipping off the container by engagement with the said rim, which inhibiting means comprise an inhibiting element adapted to be bent from the sheet at one or more bends inwards of the periphery of the cover means, whereby the whole of said element is located inwards of and spaced from the periphery or at least one said bend extends inwards (relative to the circumferential direction) from said periphery.

By virtue of this feature of inwardness, cover means can be provided that lend themselves to having a much more positive inhibiting function than arrangements not according to the invention in which, for example, a portion of the periphery, or a peripheral tab, is simply bent down at a circumferentially extending bend at the periphery.

"Circumferential" herein means along a line substantially normal to a radial direction, not necessarily at the periphery unless the context so requires. The direction of a bend refers to the direction of its fold line or, when bent through a curve rather than folded at a line, is the direction of the straight line generatrix of the curve.

The rim of the container is usually circular. Usually, the periphery of the cover means conforms generally to the shape of the rim; but in such cases it may in detail have a decorative shape, e.g. the cover may have a scalloped edge. The upper and/or lower surface of the cover may bear text and/or design, e.g. as decoration and/or as advertising matter.

The inhibiting function can be maximized if the inhibiting means are adapted to point edgewise towards the rim, preferably so that the bend would not be decreased by putative movement of the cover means in a direction to urge the inhibiting means towards the rim. In some arrangements, such movement would increase the bending. In others, it would have no effect, such as where the direction of the bend is normal to the rim.

In a first preferred arrangement two, three or more of said elements are adapted to be inside the rim of the container. In a second preferred arrangement two, three or more of said elements are adapted to be outside the rim of the container. A third preferred arrangement comprises both of said first and second arrangements, whether mutually staggered or not. In another arrangement, a pair of said elements are opposed to each other, one adapted to be inside the rim of the container and the other adapted to be outside the rim of the container.

According to another aspect of the invention, there are provided cover means for a glass or like container that are made from a flat sheet and are adapted to lie across the mouth and top rim of the container, and comprise means adapted to be bent from the sheet and used to inhibit the cover means from slipping off the container by engagement with the said rim, the inhibiting means comprising an inhibiting element adapted to be within the rim of the container.

According to another aspect of the invention, there are provided cover means for a glass or like container that are made from a flat sheet and are adapted to lie across the mouth and top rim of the container, and comprise means adapted to be bent from the sheet and used to inhibit the cover means from slipping off the container by engagement with the said rim, the inhibiting means comprising an inhibiting element adapted to be bent from the sheet at one or more bends that extend inwards (relative to the circumferential direction) from the periphery of the cover means.

Thus, a said element may be adapted to bear against (the inside and/or outside of) the container, more especially at its rim, e.g. positively, e.g. so that the element will be at less than 45 degrees to the normal to the wall of the container at the place of encountering the container, e.g. elastically, or again edgewise to the wall; or, if the cover means is designed for (e.g. is in combination with) a particular container, may actually so bear in use.

A said element may have tab form; it may be adapted for the tab to be bent downwardly and outwardly through a bend of less than 90 degrees, preferably less than 45 degrees, towards the rim; it may be adapted for the tab to be bent downwardly and inwardly through a bend of less than 90 degrees, preferably less than 45 degrees, towards the rim; the inhibiting means may comprise opposed such tabs adapted for one of the tabs to be bent downwardly and outwardly through a bend of less than 90 degrees, preferably less than 45 degrees, towards the rim and the other tab to be bent downwardly and inwardly through a bend of less than 90 degrees, preferably less than 45 degrees, towards the rim.

In suitable arrangements, the cover means are adapted for the direction of the bend of a said element to be substantially circumferential; the direction of the bend of a said element to be substantially radial; a said element to have the form of a tab and to point substantially racially, a said element to have the form of a tab and to point substantially circumferentially; a said element to be cut from the sheet apart from at said bend; a said element to have a line of weakening for ready separation from the sheet apart from at said bend; a said element to have scoring or other weakening to facilitate bending at said bend; a plurality of said elements to be spaced apart around the cover means; a plurality of said elements to be spaced at different distances from a centre to suit the diameters of respective said containers; a said element to have a non-tab form; the non-tab form to have a cross-section of V-shape in a circumferential direction; said elements, adjacent in a circumferential direction, to be arranged in mutually non-overlapping manner.

The leading edge of a tab, which points substantially radially towards the rim of the container and is bent through less than 45 degrees from the horizontal, can be curved to give broader and better contact with the rim if this is curved than can a straight-ended tab, the better to inhibit the cover from coming away from the container and, if said elements of the inhibiting means together exert pressure on the rim, this serves better to secure the cover thereto.

In possible embodiments, the arrangement is adapted for the bend to extend inwardly from the periphery of the cover sheet in its final form; the bend to be wholly spaced inwardly from the periphery of the cover sheet in its final form; a said element or inhibiting means to be wholly spaced inwardly from the periphery of the cover sheet in its final form; said inhibiting means to be both inside and outside the rim of the container; and/or the hole to be replaced by any arrangement, e.g. a criss-cross die-cut, adapted to be opened out into a hole for a straw.

The cover means may be adapted to be formed into a conical shape, preferably by non-adhesive means, e.g. by interlocking means, e.g. cut edges, e.g. die-cuts on the outer edge of the cover means, e.g. hook means, e.g. cut into said sheet, or by bending alone (e.g. as illustrated below). The formation of a conical shape produces outward pressures on the interlocked means, e.g. dovetail shapes, which keep such means securely locked together. Releasing (e.g. unlocking) the non-adhesive (e.g. interlocked) means will allow the cover means to be returned to a flat shape. A conical cover (normally used point up) can be turned upside down, the inhibiting means then being bent down (towards the container) by being bent out of the covers opposite face, e.g. for use in windy conditions. Resilience of the cover material can maintain the conical shape without the use of other mechanical means.

The inhibiting means may be depressed from the cover means using e.g. a drinking straw, finger or pen, and can then collectively produce pressure on the container, e.g. outward pressure on the inside of the drinks glass, to secure the cover to the top thereof, to protect the contents thereof, e.g. drinks, e.g. wines, spirits, teas and coffees.

The cover means may be of thin card, may be of outer diameter, length or width 30-150 mm, preferably 50-120 mm, may be of weight 150-250, preferably 180-240 gsm, more preferably 180-200 gsm, e.g. that known under the trade name of "Invercote G solid bleached board of medium density", may be coated or laminated on one or both sides with a layer of protective material, e.g. for hygiene and/or so as not to be deleterious to human consumption, e.g. being produced from materials that comply with appropriate food contact materials regulations, e.g. the current 2006 European Union food contact materials regulations.

The covers can be of any shape that provides full cover for a container, e.g. a drinks glass, and can be circular, oval, square, triangular, octagonal, hexagonal and/or rectangular, or again can be shapes that include animals, TV characters, numbers, alphabetical letters, superstars, logos, emblems, flags, love messages and lots more, or these can be incorporated into the cover design. The covers can be flat, dimple, crinkle, pyramidal or conical shaped depending upon the folding arrangement of circumferential and/or radial crease lines, which preferably intersect normally (at right angles), and/or the folding arrangement may allow reduction in the size of the cover to fit a drinks glass or drinking vessel or other container as required.

The covers can be used for all drinks glasses, including for beer, wine and other drinks in cases that do not involve or require the use of drinking straws. In such a case, the cover is adapted to be such that the action of using a finger to apply pressure downwards at one portion of the outer edge of the cover will lever the cover up at the opposite side of the container (e.g. a drinks glass): this will allow a drink to be taken from the drinks glass without having to remove the cover entirely from the drinks glass. This presupposes that the cover is adapted to extend beyond the rim of the container, as is the case with all the embodiments described herein.

The covers can also provide protection for the contents of a drinks glass from direct sunlight, and thus slow down the melting of ice in drinks as well as increase the lifespan of the drink. They can be used to protect drinks and oral medication dispensed in drinks glasses from airborne pollutants and bacteria carried by flies, and can be used in hospitals, schools, emergency refugee situations, as well as war and disaster zones to protect drinks glasses and vessels and reduce risks to health caused by bacteria carried by e.g. flies and other airborne insects.

The straw hole need not be at the centre of the cover, it might in some cases be more useful nearer, or adjacent, to the rim. A plurality of means (e.g. die-cut criss-crosses) may be located in different places on the cover to provide a plurality of possible straw holes, one of which is selected, and formed (pressed out), by the user. The straw hole need not be at the uppermost point of the cone.

The covers can provide an advertising medium which brings products and services right under the nose of the consumer. By printing on the top or bottom of the cover, a second use is made of this product wherein, for example, commercial advertising and public sector information can be incorporated in the cover design.

The covers can be stacked and peeled from stand-alone dispensers placed on bars and restaurant tables. Bar staff can easily add such a cover to a drinks glass—it takes less than two seconds to erect a conical glasscover from a flat shape.

The cover can be an adjustable, movable cover that fits over the top of drinks glasses, mugs, cups and other open-topped drinking vessels. The covers can be manufactured as flat shapes and can be made from paper, cardboard, plastic, foil or other flexible materials. As exemplified below, they can be adjusted manually (by the user) in various ways.

The cover means may be in the form of a blank, a flat blank, a conical blank, or in the form of a cover with formed said inhibiting means.

According to another aspect of the invention, there are provided any such cover means in combination with the container.

DESCRIPTION WITH REFERENCE TO THE DRAWINGS

Reference will now be made by way of example to the accompanying drawings, in which:

FIG. 8 is a view as FIG. 7 of another development of the FIG. 1 embodiment, being a combination of the embodiments of FIGS. 7 and 8; and FIG. 8A is a reproduction of an element of FIG. 8 showing additional references;

Figure 1:
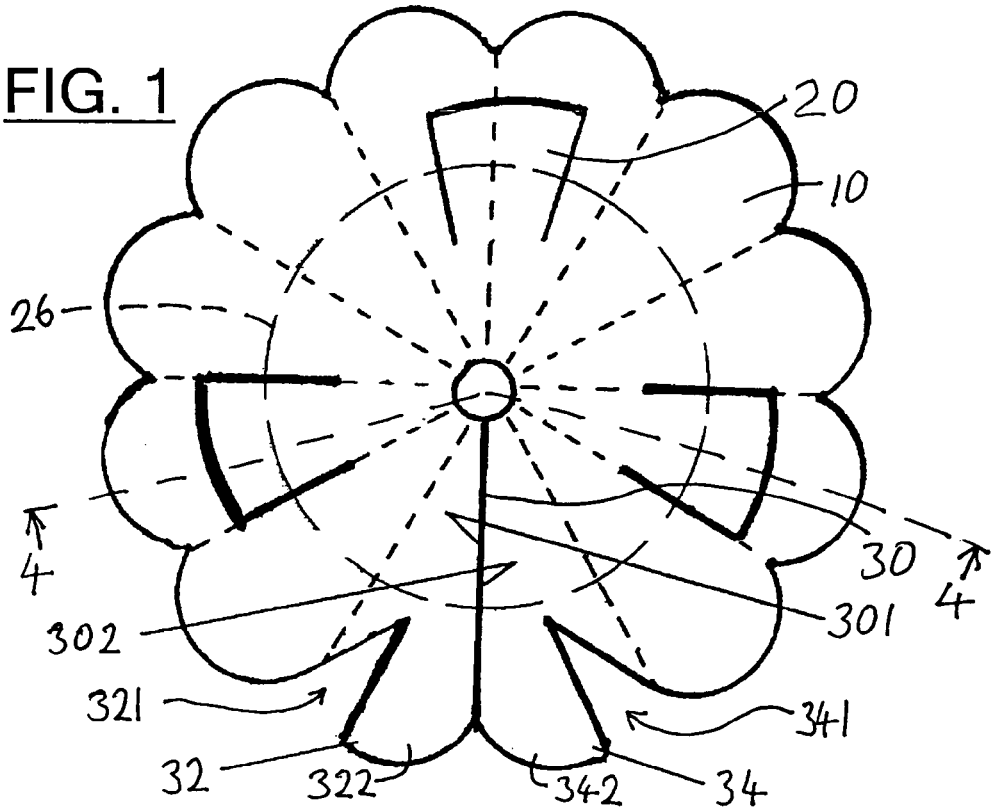
FIG. 1 is a plan view of a first cover means embodying the invention.

Referring to the drawings, a glass cover 10 is made from a sheet of thin card of weight 180-200 gsm, coated or laminated on one or both sides with a layer of protective material as described above, in the shape shown in FIG. 3, die-cut at the heavy lines 12, with a central hole 14 for a straw 16 and having a scalloped peripheral edge 18. It has inhibiting means 20, comprising inhibiting elements 20, defined by the de-cut lines 12 and bend lines 22, spaced around the cover 10. (The bend lines 22 may be preformed as weakening in cover 10 or, when cover 10 is flat, may simply be notional since bends will be formed thereat by the user.) To use the cover 10, it is placed on top of a wine glass 24 (shown schematically in FIG. 4), and the end of straw 16 is used to press down the tab-form elements 20 at the bend lines 22. These engage the inside of the rim 26 of the glass 24 and prevent cover 10 from slipping off glass 24. Depending upon the diameter of glass 24, the tabs 20 are pressed down less or more to engage the rim 26. The tabs 20 can maintain engagement with the rim 26, usually engaging the rim 26 resiliently. If the diameter of glass 24 is too large for the engagement to be maintained, nevertheless the tabs 20 once having been bent down stay bent down, and cover 10 can then move only slightly from side to side until one or two of them encounter rim 26 and there is engagement therebetween, thus preventing cover 10 from slipping off glass 24. In practice, the small gaps that may open up around the de-cut lines 12 are too small to allow foreign matter to enter and contaminate the drink. The covers 10 may be taken from a stack of them by a barman when serving a drink, who may himself depress tabs 10 or may leave this to the drinker. The edge of straw hole 14 and/or lines 12 (or part thereof) may not be pre-cut but be weakened, e.g. by being perforated, to be separated by the barman or drinker, e.g. using the straw 16.

Figure 2:
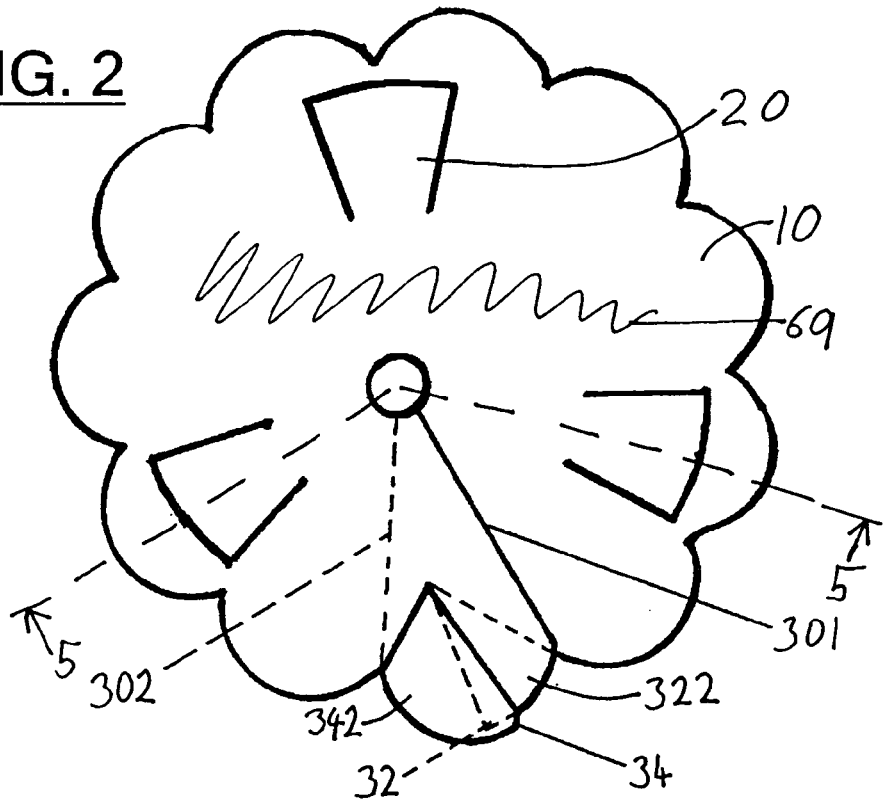
FIG. 2 is a plan view of the first cover means hooked together to form a conical cover means.
Figure 3:
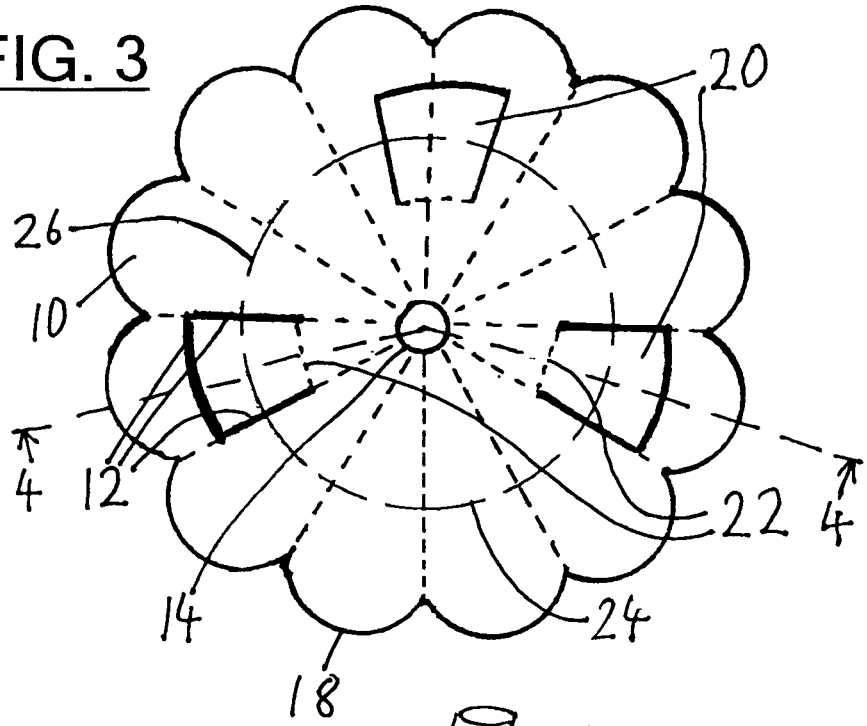
FIG. 3 is a plan view of a second cover means which may be used as it is, or may be further cut to form said first cover means.
Figure 4:
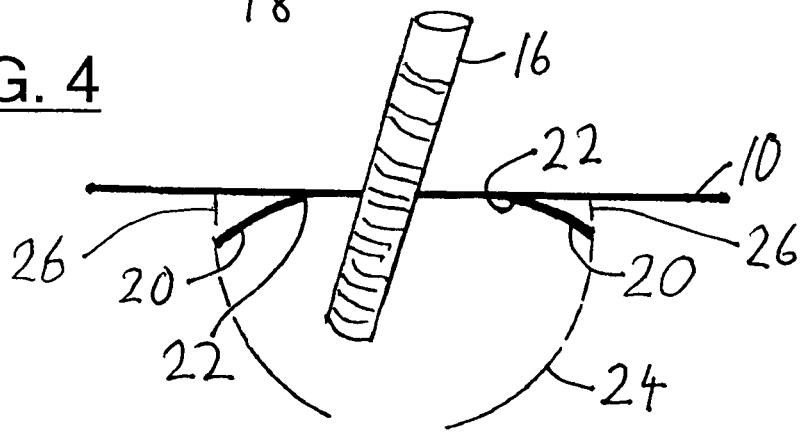
FIG. 4 is a side cross-sectional view taken along a line 4-4 of FIGS. 1 and 3.
Figure 5:
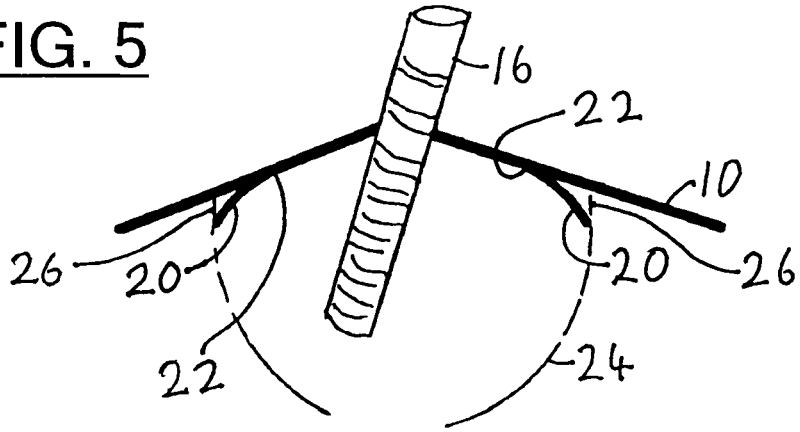
FIG. 5 is a side cross-sectional view taken along a line 5-5 of FIG. 2.

In a development, shown in FIG. 1, of the FIG. 3 arrangement, the cover 10 is provided with a de-cut radial line 30 (forming, as seen in FIG. 1, a left-hand edge 301 and a right-hand edge 302) from hole 14 to periphery 18, and a pair of suitably shaped notches 321, 341 are cut out to provide interlocking cut edges thereof and thus interengageable hook portions 322, 342. This may be used flat, as shown in FIG. 3 or the hook portions 322, 342 may be interengaged as follows. Portion 322 is moved over and above and beyond portion 342 until point 32 is beyond (to the right as seen in FIG. 1) of point 34; point 32 is then moved back below point 34 until the hook portions 322, 342 fully engage, as seen in FIG. 2. This engagement movement causes cover 10 to adopt a conical shape, as seen more clearly in FIG. 5.

Figure 6:
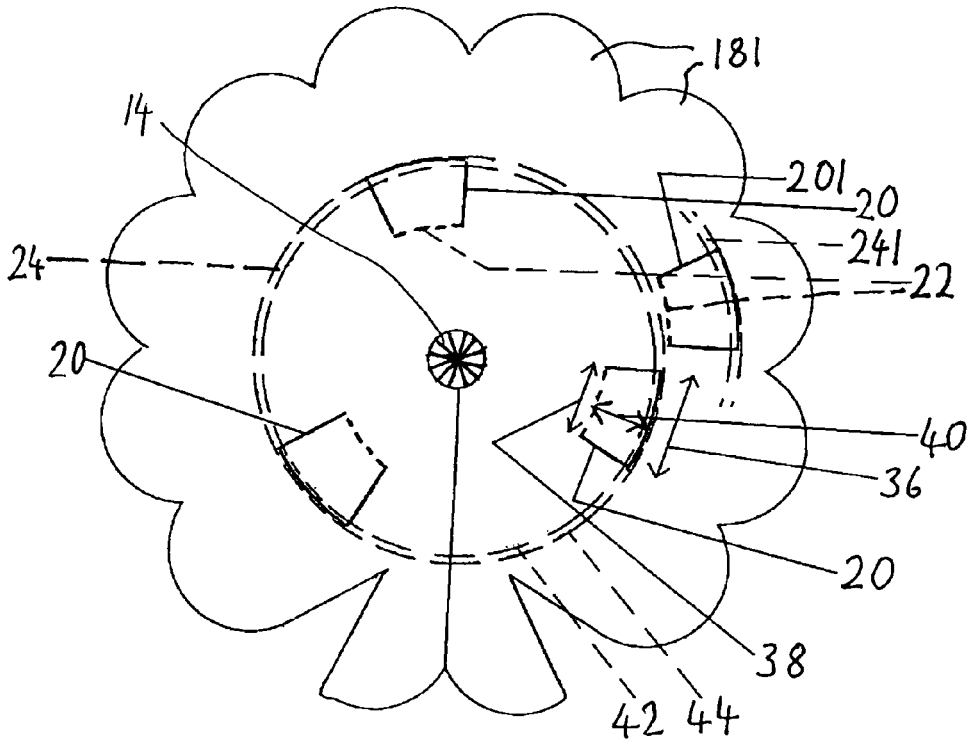
FIG. 6 is a part-schematic view as FIG. 1 showing a development of the FIG. 1 embodiment.

It is seen from FIG. 6, that tabs 20 may be located at different distances from the central hole 14 to match different diameters of glass 24, 241. For example, tabs 20 suit a wineglass 24, while tabs 201 suit a tumbler 241. Cover 10 may have only tabs 20 or only tabs 201; or may have both, preferably tabs 20 being staggered around cover 10 relative to tabs 201 in order not unduly to weaken cover 10. For clarity, FIG. 6 shows only one tab 201 but there will in fact be several spaced around cover 10. Tabs 20, 201 have a greatest width 36 (at their free end, opposite bend line 22) of 20 mm, a narrowest width 38 (at bend line 22) of 10 mm, and a depth 40 of 10 mm.

Figure 7:
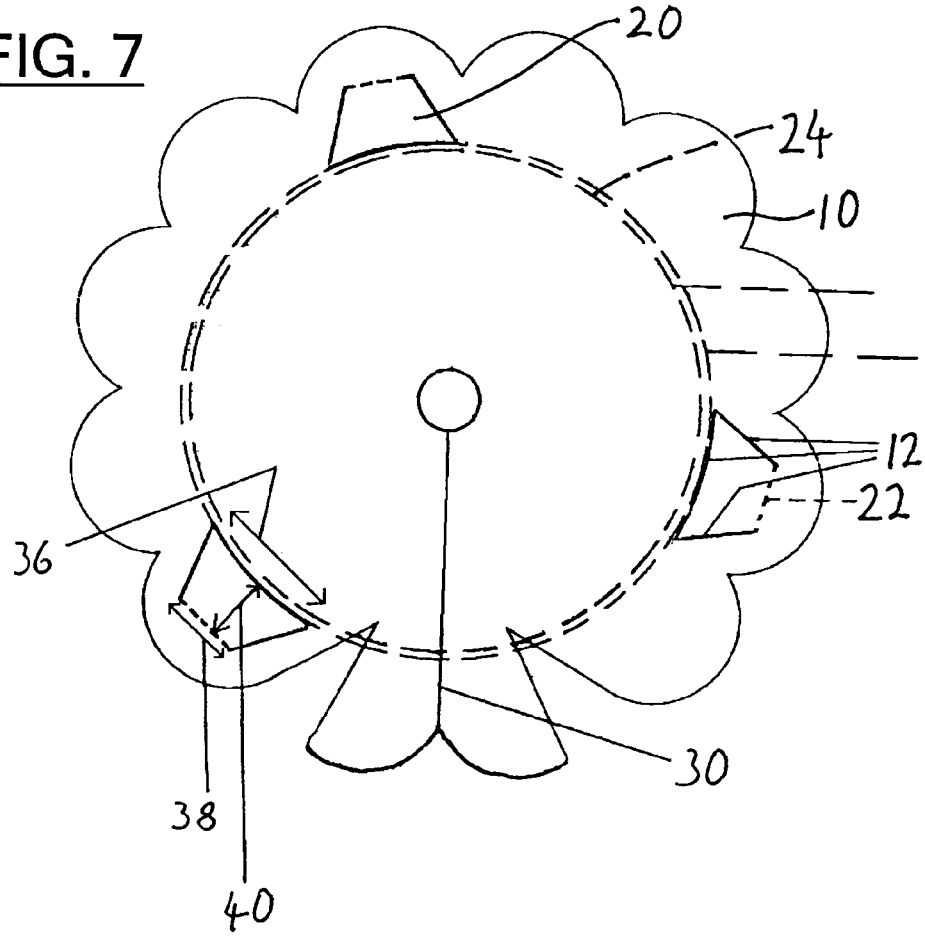
FIG. 7 is a view as FIG. 6 of another development of the FIG. 1 embodiment.

In the FIG. 7 arrangement, the tabs 20 are outside the glass 24 but have the same sizes 36, 38, 40 as the tabs 20 of the FIG. 6 arrangement.

In the FIG. 8 arrangement, each substantially trapezoidal tab 20 of the earlier-described embodiments is replaced by a pair 202 of equal-sized, opposed, rectangular tabs 20, 21 formed by two bend lines 22 and an H-arrangement of three die-cut lines 12. A tab pair 202 is also shown separately, for clarity. The tabs 20, 21 have a uniform width 37 of 20 mm and a combined depth 41 of 30 mm. The spacing 39 of tabs 20 from peripheral edge 18 is 10 mm. When, resting on glass 24, tabs 20, 21 of a pair 202 are depressed at its central cut line 12, they spread apart slightly at their free ends so that tab 20 bears against the outside of the rim 26 of glass 24 and tab 21 bears against the inside of this rim. Together the pair 202 of tabs 20, 21 clamps the rim 26 between them (so that glass 24 could even be turned upside down without cover 10 coming off), and it may be sufficient for cover 10 to have only one (or two, arranged on opposite sides of cover 10) pairs 202 of tabs 20, 21.

Figure 9:
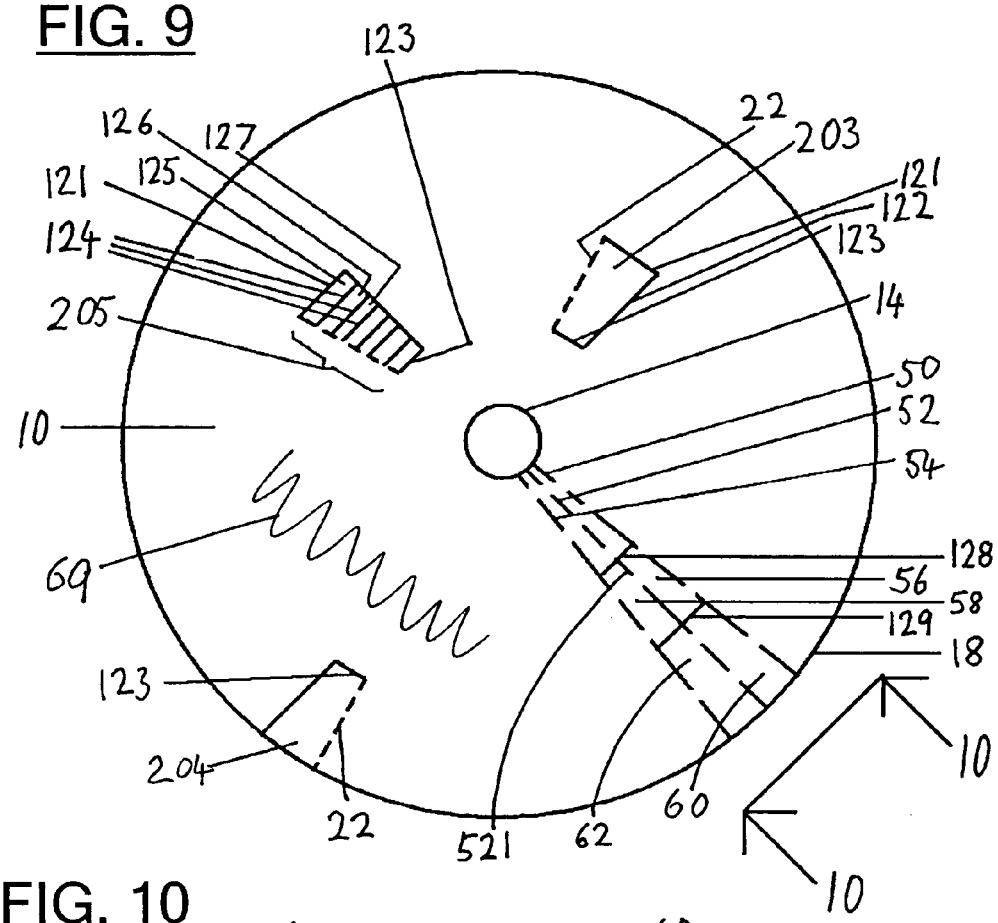
FIG. 9 is a view as FIG. 1, showing schematically a number of further developments of the FIG. 1 embodiment

FIG. 9 illustrates a number of possible variations. A tab 20 may be replaced by a tab 203 that extends circumferentially rather than radially. This has de-cut edges 121, 122, 123 and a bend line 22. Tab 203 presents a circumferential de-cut edge 121, 123 to the rim of a glass 24, either edge 121 to the inside of the rim of glass 24 or edge 123 to the outside of the rim of glass 24 depending upon the radial position of tab 203 and the diameter of glass 24. Again, tab 203 may be located at the peripheral edge 18 as tab 204, and then engages glass 24 by means of its inner de-cut edge 123. Again, tab 203 may be formed as tab 205 with a number of circumferential de-cut lines 124 intermediate its end circumferential de-cut lines 121, 123, so that tab 205 has a comb-like form with separately depressible fingers 125, 126, 127. (Strictly speaking, each of the fingers 125 etc is itself a tab-form said inhibiting element.) If the rim of glass 24 underlies the finger 126, for example, neighbouring fingers 125, 127 can be depressed to engage the outside and inside of the rim respectively. If the glass 24 has a narrower diameter, other fingers between cuts 124 can be depressed on either side of its rim to grip glass 24, or at least stop cover 10 from slipping off it.

Figure 10:
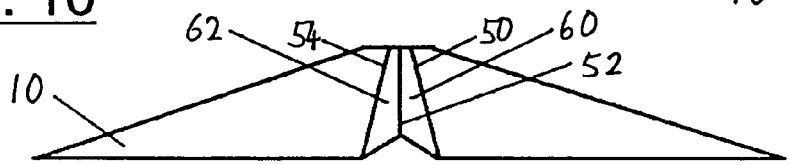
FIGS. 10, 11 and 12 are a side view and two fragmentary edge views respectively, looking in the direction 10-10 in FIG. 9.
Figure 11:
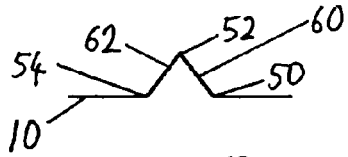
Figure 12:
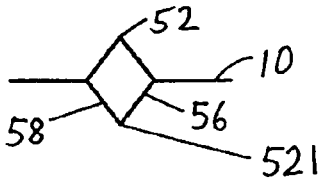

Rather than using hook means (portions 322, 342) to achieve a conical shape, this conical shape can be achieved solely by bending. Cover 10 may have radial score lines 50, 52, 54 where it is bent, upwards at lines 50, 54 and downwards at line 52 to the profile shown in FIG. 11, and as seen in the side view, FIG. 10, so that line 52 forms an upstanding ridge 52. This profile may be obtained by bending cover 10 downwards along the whole of line 52, pinching together sides 60, 62, and then bending the cover 10 upwards at lines 50, 54. Furthermore, if there are two transverse die-cut lines 128, 129 across this ridge 52, that extend from one to the other of bend lines 50, 54, a central part 521 of ridge 52 can be depressed as shown in FIG. 12 to provide a non-tab-form inhibiting means 521 that will engage a glass rim internally at its outer edge at line 129 or internally at its edge 128 depending upon the diameter of the rim and the racial position of the inhibiting means 521.

For all the embodiments, the inside and outside diameters 42, 44 of the rim 26 of wineglass 24 are 64 mm and 68 mm, and of tumbler 241 are 78 mm and 82 mm. Cover 10 has an outer diameter of 120 mm; each of scallops 181 is semicircular of diameter 25 mm.

Hole 14 may be replaced by a criss-cross die-cut 14, illustrated by way of example in FIG. 6, adapted to be opened out into a hole 14 for a straw 16.

Thus, these embodiments provide cover means 10 for a wineglass or like container 24, that are made from a fiat sheet 10, comprise means 20, 521 adapted to be bent from the sheet 10 and used to inhibit the cover means 10 from slipping off the container 24, which inhibiting means 20, 521 comprise an inhibiting element 20, 521 adapted to be bent from the sheet 10 at one or more bends 22, 50, 54 inwards of the periphery 18 of the cover means 10, whereby the whole of said element 20, 521 is located inwards of and spaced from the periphery 18 or at least one said bend 22 extends inwards from said periphery 18.

The rim 26 of the container 24 is circular. The periphery 18 of the cover 10 conforms generally to the shape of the rim 26; but it has in detail a decorative shape, a scalloped (with scallops 181) edge 18. The upper surface bears text and/or design 69, as decoration and/or as advertising matter 69.

To maximize the inhibiting function, the inhibiting means 20, 21, 521 are adapted to point edgewise towards the rim 26, so that the bend would not be decreased by putative movement of the cover means 10 in a direction to urge the inhibiting means 20 etc towards the rim 26. In the arrangements of FIGS. 1 to 8, such movement would increase the bending. In the arrangements of FIGS. 9 to 12, such movement would have no effect, where the direction of the bend 22 etc is normal to the rim 26.

In the arrangements of FIGS. 1-6, two, three or more of said elements 20 etc are adapted to be inside the rim 26 of the container 24. In the arrangement of FIG. 7, two, three or more of said elements 20 are adapted to be outside the rim 26 of the container 10. The arrangements of FIG. 8 and tab 205 of FIG. 9 comprise both the inside and the outside features of both the FIGS. 1-6 and the FIG. 7 arrangements, and may be mutually staggered or not. Specifically, in the FIG. 8 arrangement, a pair 202 of said elements 20, 21 are opposed to each other, one (21) adapted to be inside the rim 26 of the container 10 and the other (20) adapted to be outside the rim 26 of the container 24.

Specifically, the embodiments of FIGS. 1-6 provide cover means 10 for a glass or like container 24 that are made from a fiat sheet 10, and comprise means 20 etc adapted to be bent from the sheet 10 and used to inhibit the cover means 10 from slipping off the container 24, the inhibiting means 20 etc comprising an inhibiting element 20 etc adapted to be within the rim 26 of the container 20 etc.

The FIG. 9 arrangement provides cover means 10 for a glass or like container 24 that are made from a flat sheet 10, and comprise means 204 adapted to be bent from the sheet 10 and used to inhibit the cover means 10 from slipping off the container 24, the inhibiting means 204 comprising an inhibiting element 204, 521 adapted to be bent from the sheet 10 at one or more bends 22, 50, 54 that extend inwards from said periphery 18. Of course, the depressed ridge portion 521 may alternatively extend from the periphery 18 to the cut line 129 and the cut line 128 may be omitted or not used; inhibiting means 521 would then encounter the outside of the rim 26.

Thus, a said element 20 etc, in all the arrangements illustrated, is adapted to bear against the container 10, more especially at its rim 26, e.g. positively, e.g. so that the element 20 etc will be at less than 45 degrees to the normal to the wall of the container 10 at the place of encountering the container, e.g. elastically, or again edgewise to the wall; or, if the cover means 10 is designed for (e.g. is in combination with) a particular container 10, will actually so bear in use.

A said element 20 etc has tab form; it is adapted in the arrangements of FIGS. 1-6 for the tab 20 etc to be bent downwardly and outwardly through a bend of less than 90 degrees, preferably less than 45 degrees, towards the rim 26; it is adapted in the arrangement of FIG. 7 for the tab to be bent downwardly and inwardly through a bend of less than 90 degrees, preferably less than 45 degrees, towards the rim 26; in the arrangement of FIG. 8, the inhibiting means 202 comprise opposed such tabs 20, 21 adapted for one 21 of the tabs to be bent downwardly and outwardly through a bend 22 of less than 90 degrees, preferably less than 45 degrees, towards the rim 26 and the other tab 20 to be bent downwardly and inwardly through a bend 222 of less than 90 degrees, preferably less than 45 degrees, towards the rim 26.

In these embodiments, the cover means 10 are adapted for the direction of the bend 22 etc of a said element 20 etc to be substantially circumferential (FIGS. 1-8); the direction of the bend 22 etc of a said element 10 to be substantially radial (FIG. 9); a said element 20 etc to have the form of a tab 20 etc and to point substantially radially (FIGS. 1-8); a said element 20 etc to have the form of a tab 203, 204, 205 and to point substantially circumferentially (FIG. 9); a said element 20 etc to be cut from the sheet 10 apart from at said bend 22 etc (all illustrated embodiments); a said element 20 etc to have a line 12 of weakening (instead of die-cut line 12) for ready separation from the sheet 10 apart from at said bend 22 etc (all illustrated embodiments); a said element 20 etc to have scoring or other weakening 22 etc to facilitate bending at said bend 22 etc (FIGS. 3-9); a plurality of said elements 20 etc to be spaced apart around the cover means 10 (FIGS. 1-9); a plurality of said elements 20 etc to be spaced at different distances from a centre (e.g. hole 14) to suit the diameters of respective said containers 24; a said element 521 etc to have a non-tab form (FIG. 9); the non-tab form 521 to have a cross-section of V-shape (FIGS. 12) in a circumferential direction; said elements 20 etc, adjacent in a circumferential direction, to be arranged in mutually non-overlapping manner (e.g. they are not so close that one can overlap the next when both are folded down).

The arrangement illustrated in FIG. 9 is adapted for the bend 22 for tab 204 and the bends 50, 54 (when the ridge is between line 129 and periphery 18) to extend inwardly from the periphery 18 of the cover sheet 10 in its final form. The other arrangements illustrated in FIGS. 1-9 are adapted for: the bend 22 etc to be wholly spaced inwardly from the periphery 18 of the cover sheet 10 in its final form for use on the container, a said element or inhibiting means 22 etc to be wholly spaced inwardly from the periphery 18 of the cover sheet 10 in its final form. The arrangement illustrated in FIG. 8 and that illustrated in FIG. 9 relating to tabs 125, 126, 127 are adapted for: said inhibiting means 20, 21 or 125, 127 to be both inside and outside the rim 26 of the container 24;

The cover means 10 in the arrangements of FIGS. 1, 2, 5, 7-12 are adapted to be formed into a conical shape, e.g. by hook means (FIGS. 1, 2, 5, 7, 8), e.g. cut into said sheet 10, or by bending alone (FIGS. 9-12).

The bend lines 22 etc are mainly substantially straight, but may be slightly curved.

In these embodiments, at different stages, the cover means 10 are in the form of a blank, a flat blank, a conical blank, or in the form of a cover 10 with formed said inhibiting means 20 etc.

It will be seen that cover means embodying the invention can comprise any one or more of the following features:

the whole of said element is located inwards of and spaced from the periphery of the cover means.

at least one said bend extends inwards from the periphery of the cover means.

the inhibiting means are adapted to point edgewise towards the rim.

the cover means are such that the bend would not be decreased by putative movement of the cover means in a direction to urge the inhibiting means towards the rim.

said putative movement would increase the bending.

said putative movement would have no effect.

the direction of the bend is normal to the rim.

two, three or more of said elements are adapted to be inside the rim of the container.

two, three or more of said elements are adapted to be outside the rim of the container.

a pair of said elements are opposed to each other, one adapted to be inside the rim of the container and the other adapted to be outside the rim of the container.

a said element is adapted to be at less than 45 degrees to the normal to the wall of the container at the place of encountering the container.

a said element has the form of a tab.

the cover means are:

adapted for the tab to be bent downwardly and outwardly through a bend of less than 45 degrees towards the rim.

adapted for the tab to be bent downwardly and inwardly through a bend of less than 45 degrees towards the rim.

adapted to have two opposed said tabs, one to be bent downwardly and outwardly through a bend of less than 45 degrees towards the rim and the other to be bent downwardly and inwardly through a bend of less than 45 degrees towards the rim.

adapted for the direction of the bend of a said element to be substantially circumferential.

adapted for the direction of the bend of a said element to be substantially radial.

adapted for a said element to have the form of a tab and to point substantially radially.

adapted for a said element to have the form of a tab and to point substantially circumferentially.

adapted for a said element to be cut from the sheet apart from at said bend.

adapted for a said element to have a line of weakening for ready separation from the sheet apart from at said bend.

adapted for a said element to have scoring or other weakening to facilitate bending at said bend.

adapted for a plurality of said elements to be spaced apart around the cover means.

adapted for a plurality of said elements to be spaced at different distances from a centre to suit the diameters of respective said containers.

adapted for a said element to have a non-tab form.

adapted for the non-tab form to have a cross-section of V-shape in a circumferential direction.

adapted for said elements, adjacent in a circumferential direction, to be arranged in mutually non-overlapping manner.

adapted to be formed into a conical shape.

adapted to be held in conical shape by interlocking means.

said interlocking means comprise hook means.

the cover means are adapted to be held in conical shape by bending alone.

the cover means are adapted to be such that the action of using a finger to apply pressure downwards at one portion of the outer edge of the cover will lever the cover up at the opposite side of the container.

It will be apparent to one skilled in the art, that features of the different embodiments disclosed herein may be omitted, selected, combined or exchanged and the invention is considered to extend to any new and inventive combination thus formed. Where a preference or particularization is stated, there is implied the possibility of its negative, i.e. a case in which that preference or particularisation is absent.

Many variations of the invention and embodiments hereinbefore described will be apparent to people skilled in the art and all such variations are to be considered as falling within the scope of the invention.

The invention claimed is:

1. A combination of a hand-held drinking container which has an open top comprising a mouth defined by a top rim, and a cover for the container, the cover comprising:

a sheet adapted to lie across the mouth and sit on the top rim and comprising:

at least one inhibiting element adapted to be made from the sheet by the action of being bent down from the sheet by the user to be used to inhibit the cover from slipping off the container by engagement of said at least one inhibiting element with the rim, said at least one inhibiting element comprising:

at least one bend line at which the element is bent down from the sheet, wherein at least part of said at least one bend line is spaced from a periphery of the cover on an inward side of the periphery and wherein said inhibiting element extends radially outwardly such that it has an edge that is configured to engage an inner surface of the container.

2. The combination as claimed in claim 1, wherein said at least one bend line is spaced from the periphery of the cover and is located entirely on the inward side of the periphery.

3. The combination as claimed in claim 1, in which all of said at least one inhibiting element is located spaced from the periphery of the cover and located on the inward side of the periphery.

4. The combination as claimed in claim 1, in which the cover is such that putative movement of the cover in a direction to urge said at least one inhibiting element towards the rim would increase the bending.

5. The combination as claimed in claim 1, in which said at least one inhibiting element comprises two or more inhibiting elements which are adapted to be inside the rim of the container.

6. The combination as claimed in claim 1, in which said at least one inhibiting element has the form of a tab.

7. The combination as claimed in claim 1, wherein the cover is adapted for said at least one inhibiting element to have the form of a tab and wherein said tab has a bend line that extends substantially radially.

8. The combination as claimed in claim 1, wherein the cover is adapted for said at least one inhibiting element to be cut from the sheet apart from said at least one bend line.

9. The combination as claimed in claim 1, wherein the cover is adapted for said at least one element to have a line of weakening for ready separation from the sheet apart from said at least one bend line.

10. The combination as claimed in claim 1, wherein said cover is adapted such that said at least one inhibiting element comprises a plurality of inhibiting elements which are spaced apart around the cover.

11. The combination as claimed in claim 1, wherein the cover is adapted for said at least one inhibiting element to have the form of a tab and wherein said tab has a bend line that extends substantially circumferentially.

12. The combination as claimed in claim 1 wherein the container is a wine glass.

13. The combination as claimed in claim 12 wherein the cover has at least one radial score line.

14. The combination as claimed in claim 1, wherein the cover has at least one radial score line configured to allow the cover to be bent up in a conical shape.

* * * * *